United States Patent [19]

Ennis et al.

[11] 3,984,012

[45] Oct. 5, 1976

[54] AUTOMATIC STORAGE AND RETRIEVAL SYSTEM FOR MOTOR VEHICLES AND THE LIKE

[76] Inventors: F. Lyman Ennis, 376 Manford Way, Pasadena, Calif. 91105; Earl R. Collins, 801 Craig Ave., La Canada, Calif. 91101

[22] Filed: Apr. 16, 1975

[21] Appl. No.: 568,722

[52] U.S. Cl. ..... 214/16.1 CC; 214/16.1 R

[51] Int. Cl.[2] ..... E04H 6/06

[58] Field of Search ..... 214/16.1 R, 16.1 C, 214/16.1 CC, 16.1 CD, 16.1 CE

[56] References Cited

UNITED STATES PATENTS

| | | | |
|---|---|---|---|
| 3,390,791 | 7/1968 | Baldwin et al. | 214/16.1 CC |
| 3,414,141 | 12/1968 | Rougemont | 214/16.1 CC |
| 3,710,957 | 1/1973 | Small | 214/16.1 CC |
| 3,876,085 | 4/1975 | Bright | 214/16.1 CC |

*Primary Examiner*—Robert J. Spar
*Assistant Examiner*—R. B. Johnson
*Attorney, Agent, or Firm*—James T. English

[57] ABSTRACT

An automatic storage and retrieval system for motor vehicles has a plurality of elevators for conveying automobile support pallets to and from a plurality of tiers, the support pallets being moved off an elevator onto a cart by a transfer mechanism on the cart, and into storage stalls, under automatic sequence control by a programmable controller; the sequence of events being displayed on an interactive terminal together with storage location data, and recorded in programmable controller memory for later retrieval by automatic sequence upon command.

5 Claims, 56 Drawing Figures

FIG-41a

FACILITY ENTRY AND STORAGE SEQUENCE

Sequences described below are for "first day" operation of the system. The system is set for rapid storage of cars.

The system consists of:

Two Elevators X and Y. Each Elevator has an Entry Platform & Exit Platform.

Seven Levels A, B, C, D, E, F, G. Each level has one cart A - G

Twenty two stalls per level 1 - 22. Each Stall has a designated pallet 1 - 22

Total Stalls 154.

When system is ready, the following conditions exist:

Pallet 1A on Entry Platform X

Pallet 1C on Exit Platform X

Pallet 1B on Entry Platform Y

Pallet 1D on Exit Platform Y

Carts A & C by Elevator X

Carts B & D by Elevator Y

Carts E & G by Elevator X with Pallets 1E & 1G

Cart F by Elevator Y with Pallet 1F

Elevators X & Y at Entry Level

Safety Screens and Gates on Entry Platforms are down

Safety Screens and Gates of Exit Platform are up

Pallet Destinations are in Memory

Sequence for Elevator X (similar sequence for Elevator Y)

Driver drives car onto Pallet 1A

Driver manually activates Parking Sequence

* SYMBOL -#- INDICATES THE INITIATION AND COMPLETION OF THE DESCRIBED SEQUENCE.

FIG 41c

FACILITY RETRIEVAL AND EXITING SEQUENCE

Retrieval is on a random basis so conditions of the system will vary. In the sequence below the Driver of the car in Stall 1A arrives to get his car. The Gates of the Exit Platform X are down with an empty Pallet 7F that has just been vacated by the previous patron. The Elevator has received a Pallet 6B from the Entry Platform and is proceeding to level B to return Pallet 6B.

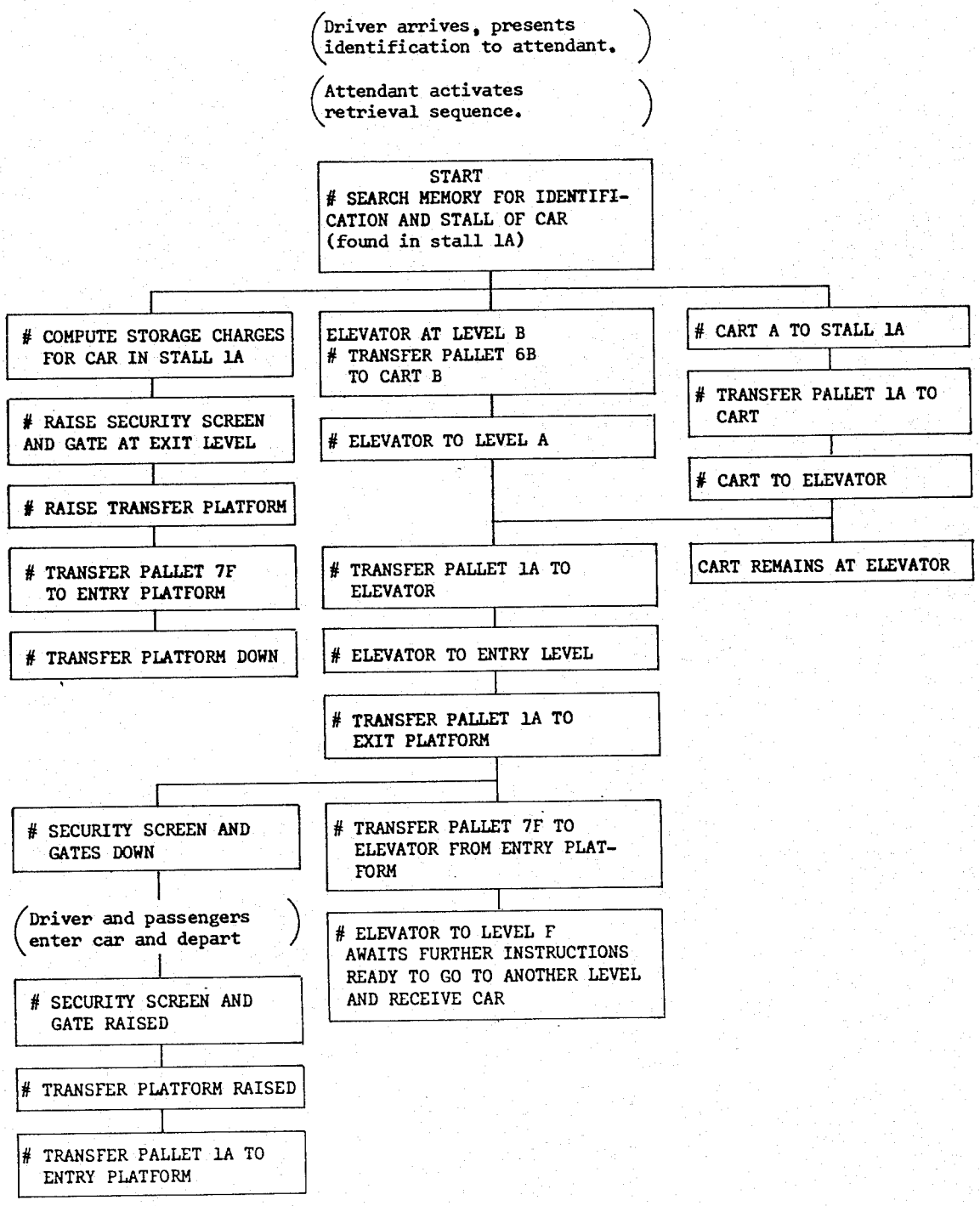

AUTOMATIC STORAGE AND RETRIEVAL SYSTEM FOR MOTOR VEHICLES AND THE LIKE

BACKGROUND OF THE INVENTION

1. Field of the Invention

This invention relates to systems for parking automobiles, and more particularly to an automatic or semi-automatic system that is faster than prior art systems which are generally too slow to meet modern requirements for large scale parking and return of automobiles. The invention is in the general field of material or article handling (class 214) which includes storehouses for wheeled vehicles (subclass 016-1).

2. Description of the Prior Art

The prior art teaches the use of multi-level storge structures and specific mechanisms for storage of automobiles therein. A representative patent in the prior art is U.S. Pat. No. 3,499,553 to Karl Heinz Stienen which has some of the elements of the instant invention, but it is deficient in some of the requirements for a storage system, which make it not adequate for a practical modern parking facility. The prior art does not, in general, consider the greatest problem in storage and retrieval of automobiles on a commercial basis such as would be involved in the parking of vehicles by shoppers in a crowded and hurried invironment in a shopping center where, on the average, storage or retrieval times of more than a few minutes would not be tolerable. Also, the requirement for automatic substitution of equipment to obviate problems of down-time due to equipment failure, to avoid catastrophic traffic jams, is of utmost importance. In general, none of the prior art patents describe a system which has the characteristics of speed, fault tolerance and low energy consumption required for a modern practical system. In prior art systems a ferris-wheel arrangement of stalls is often used or a gantry having an elevator therein is moved to store and retrieve vehicles from a pidgeon-hole structure. These arrangements are impractical because of their high energy consumption in moving large masses and their susceptibility to structural breakdown.

The prior art does, in general, consider the compactness and efficient utilization of storage space which is a salient feature of the instant invention, but does not define the optimum practical structural configuration to be used in order to maximize the speed of operation of the system so that it can be functional within commercial time constraints and minimize mechanical failures. In the preferred embodiments of the instant invention, consideration was given to the optimum configuration and a modular structure was chosen together with dynamic elements that move a single automobile at a time, obviating the problems of large mass movement.

Another area in which the prior art is lacking is in the practical implementation of a reliable control system having sensors for real-time display of the status of the total system and electrical ladder displays for indicating what events in the storage-retrieval cycle have been completed, so that corrective overrides can be entered at an interactive terminal by a supervisor.

BRIEF SUMMARY OF THE INVENTION

It is an object of the present invention to provide a system in which a storage and retrieval procedure can take place in a short time.

It is another object of the present invention to display the status of the storage facility at all times, including the individual events of the storage-and-retrieval cycles for instant readout by the supervisor of the facility.

It is a further object of the present invention to provide a storage system for automobiles wherein the storage-and-retrieval is done automatically by a programmable controller.

It is another object of the invention to provide a system having flexibility of configuration for adaptability to a variety of sites and suitability to underground or above ground installation.

It is another object of the invention to provide a low energy-consuming system which moves only the particular automobile to be stored or retrieved at one time as opposed to gantry, ferris-wheel and carousel structures.

It is another object of the invention to provide a modular system that allows the contents of a plurality of modules to be dispersed within the same time span as a single module and allows isolation of faults.

According to the invention, a storage system for motor vehicles comprises: a storage structure having a plurality of tiers with storage stalls in each of the tiers, a transfer mechanism mounted on a motor driven cart for moving pallets into and out of each of the stalls, and into and out of an elevator on each tier; an elevator accesses the stalls at each tier from an entry level.

The loading-and-unloading means on each cart is transfer mechanism for engaging a pallet on the elevator and moving it onto the cart and disengaging the pallet after moving it from the cart into a stall and vice versa, upon command from the programmable controller. A display panel at the operator's terminal monitors the status of the system and the storage-and-retrieval sequences. A programmable controller and interactive terminal, using a hard-wired electronic logic program sequence, provides the normal sequences of events or the interactive override, by energizing and de-energizing switching circuits controlling the movements of the elevator, the carts, and the transfer mechanism on each cart, and displays the sensor signals. The interactive terminal also allows override of the switching circuits for operational reasons such as fault tolerance, whereby a storage-retrieval cycle can be accomplished by switching to auxiliary or redundant equipment.

The invention will be more readily understood from the description of embodiments thereof given by way of example hereinafter with reference to the accompanying drawings, in which.

Figures 10A, 10B, 10C:
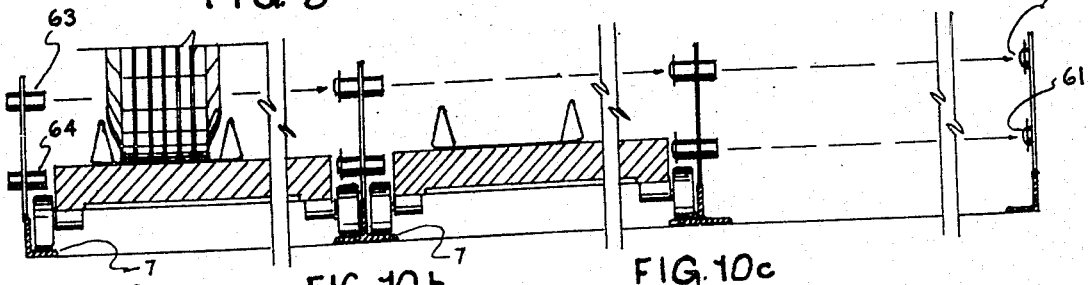

FIGS. 10*a*–10*c* are schematic drawings of the stall occupancy sensing means.

FIGS. 11 through 16 are detail drawings of a pallet.

Figure 17:
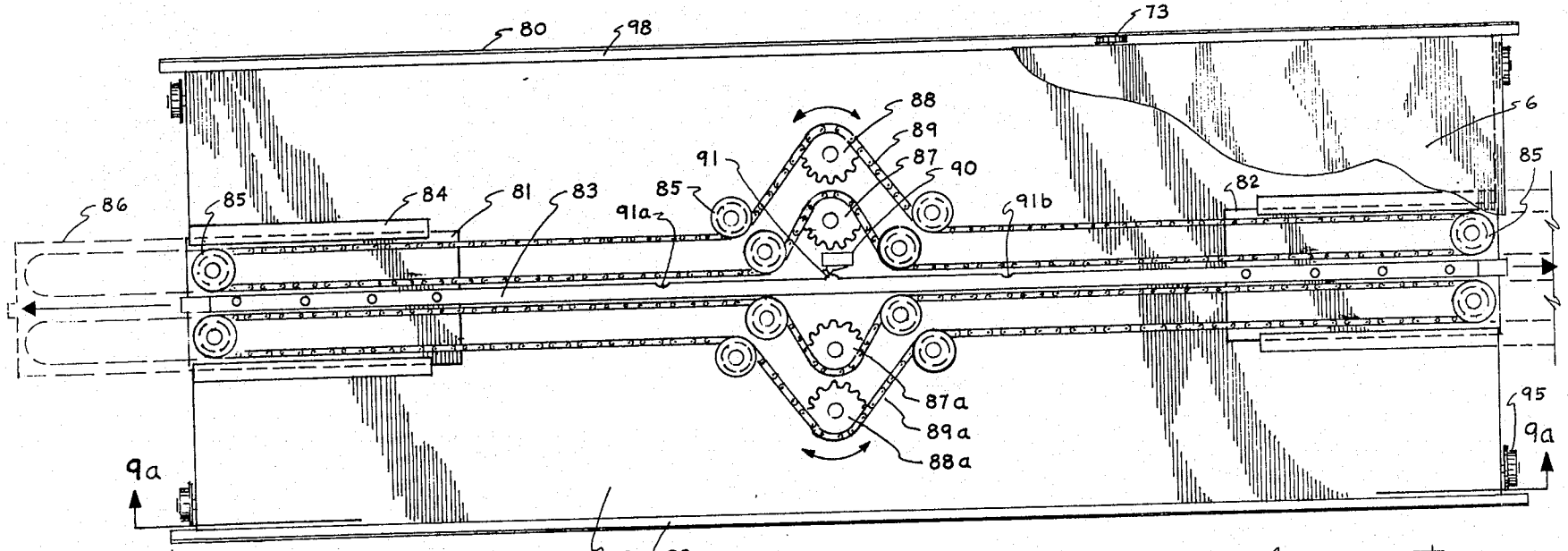

FIG. 17 is a drawing of the transfer mechanism top view.

Figure 18:
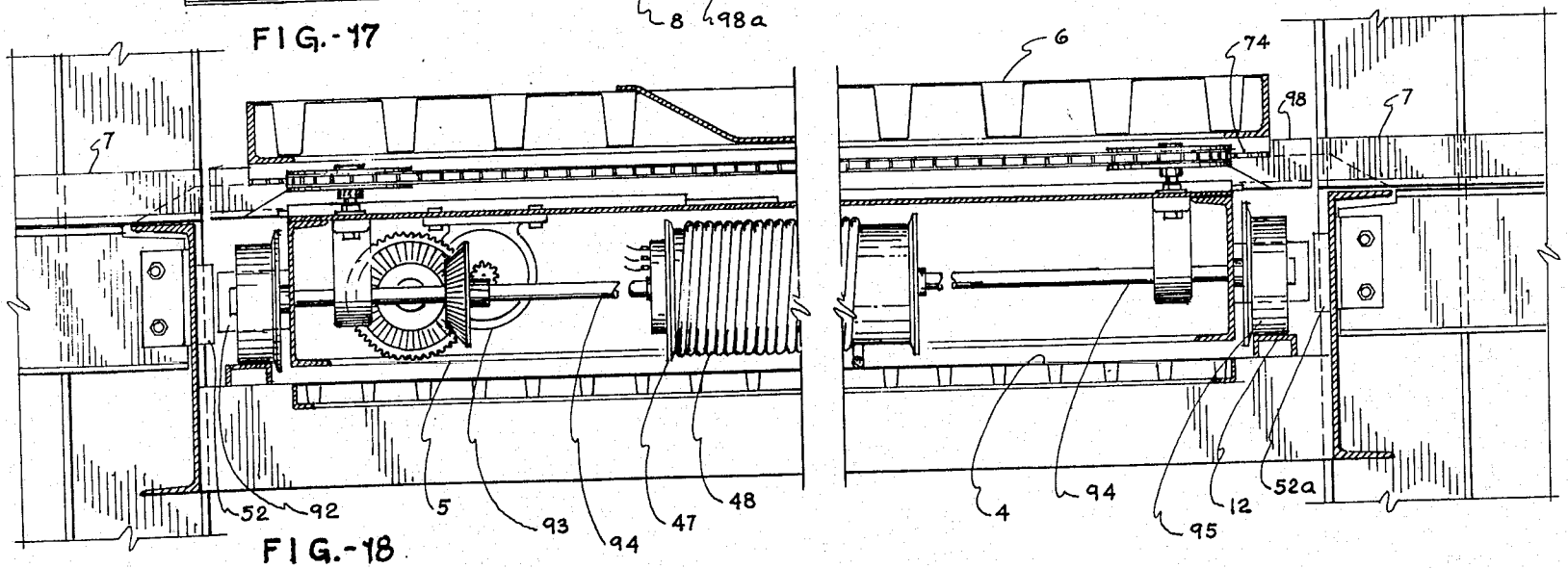
Figures 19, 20, 21, 22:
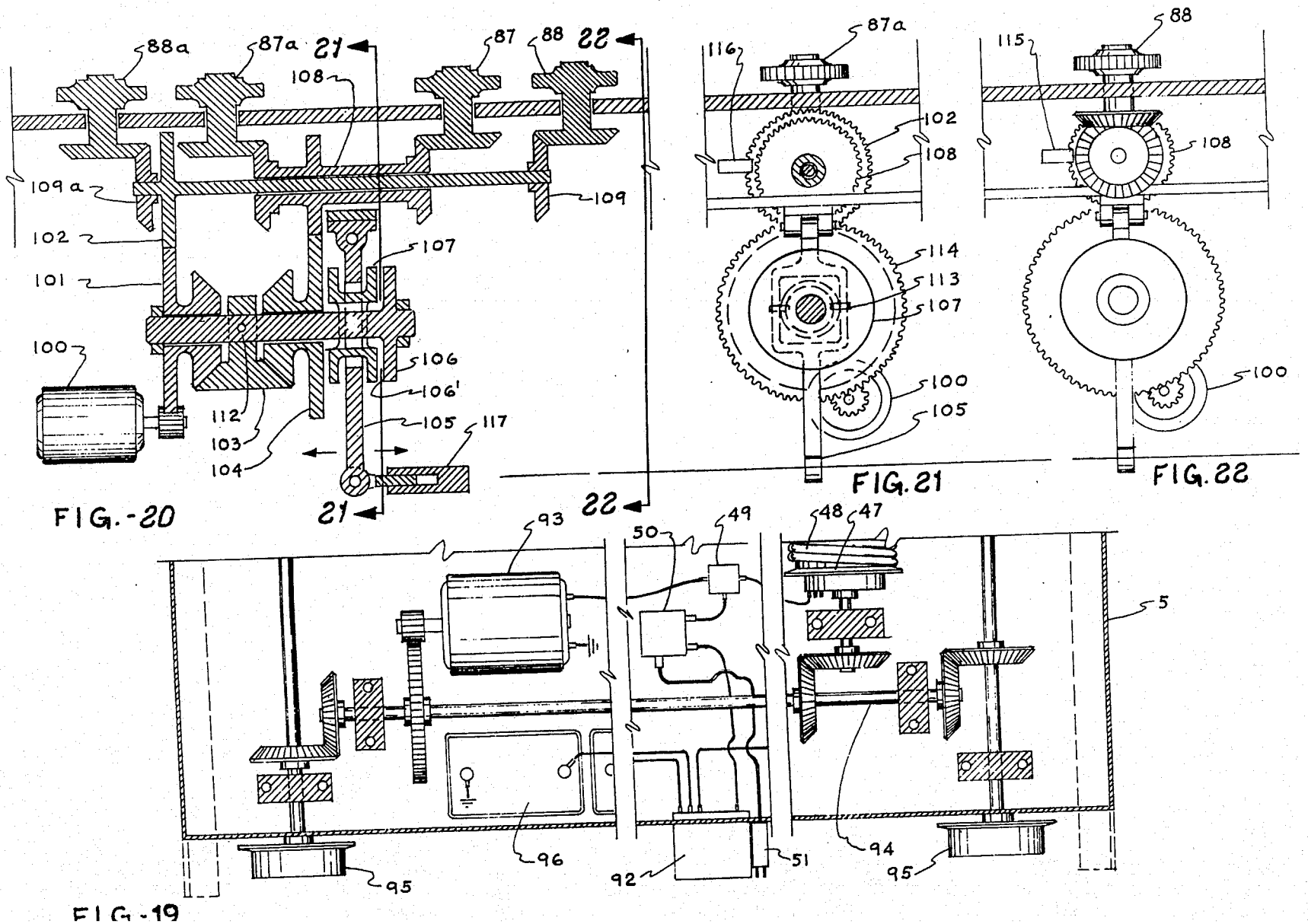

FIGS. 18 and 19 are drawings of the cart.

FIGS. 20, 21 and 22 are drawings of the transfer mechanism bottom view in cross section.

Figure 1:
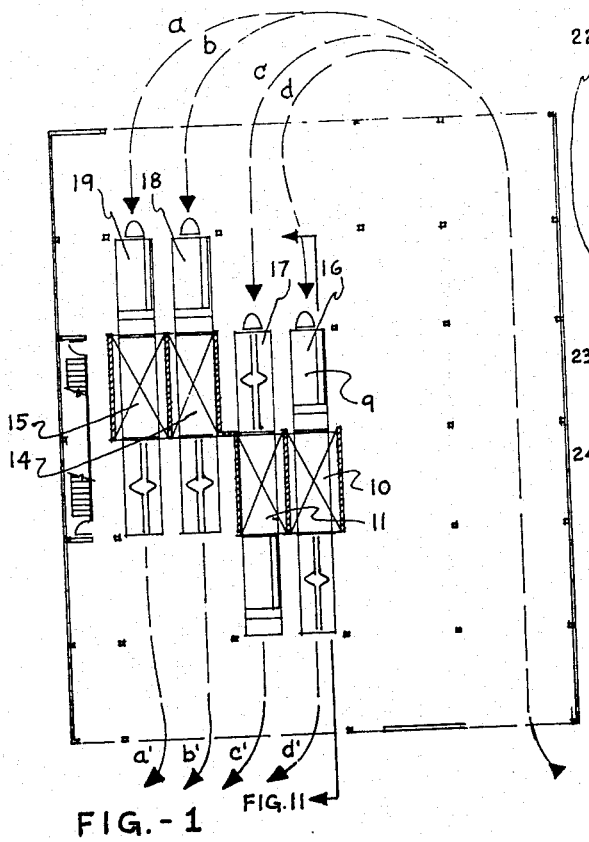
FIG. 1 is a plan view of the entry/departure level of a two module configuration.
Figure 23:
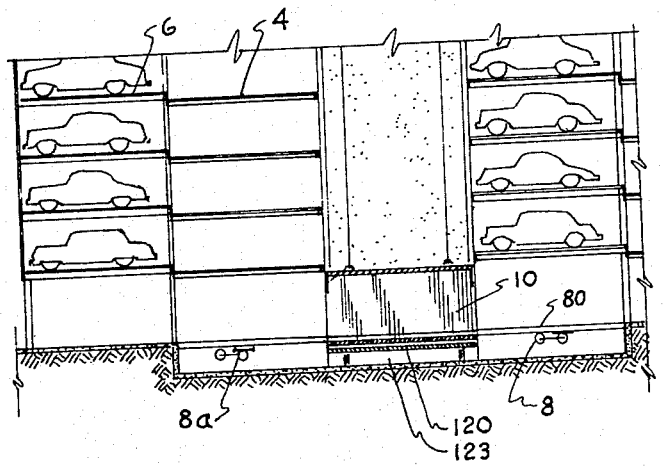
Figure 26A:
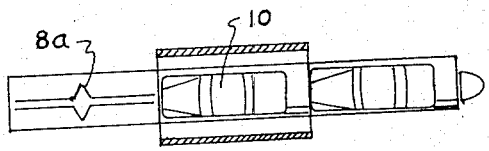
Figure 26B:
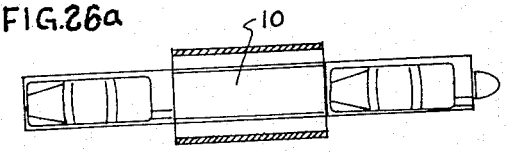
Figure 26C:
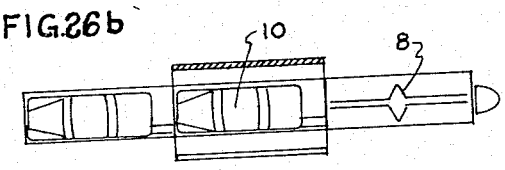
Figure 26D:
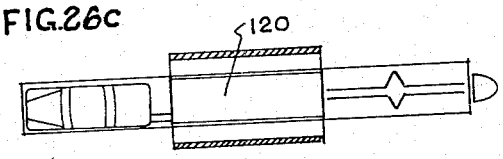
Figure 26E:
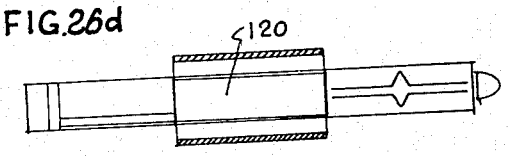
Figure 26F:
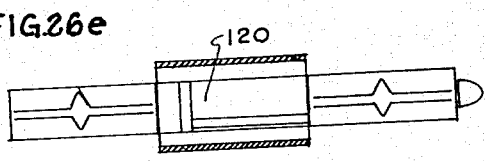
Figure 26G:
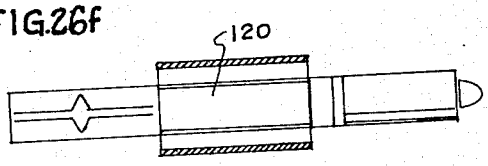
Figure 26H:
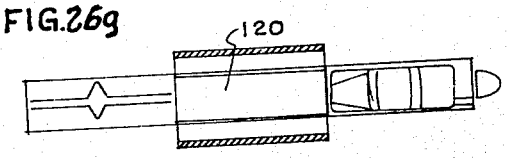
Figure 26A:
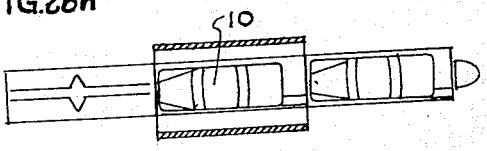
Figure 26B:
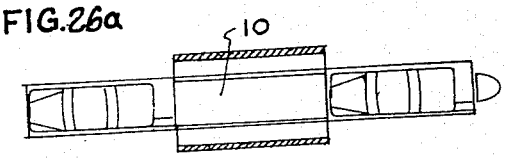

FIG. 23 is a section showing the vertical structure of FIG. 1.

Figure 25:
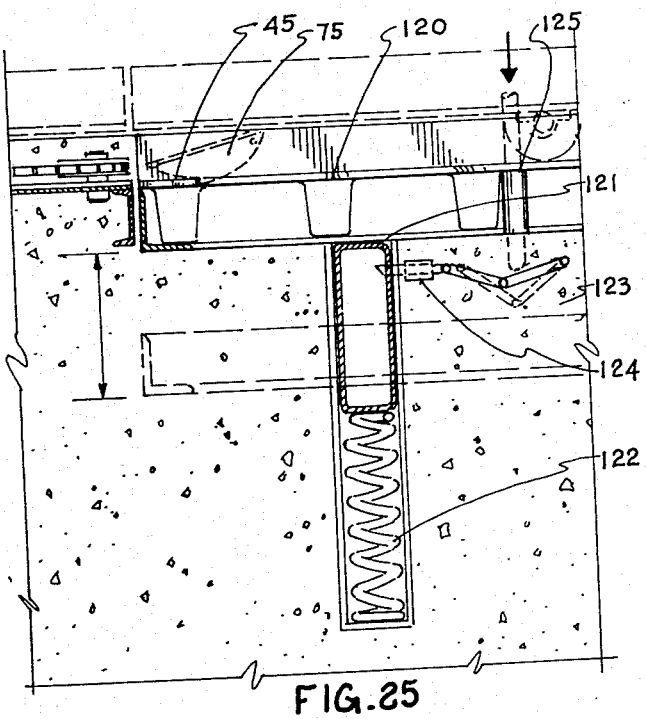
Figure 24:
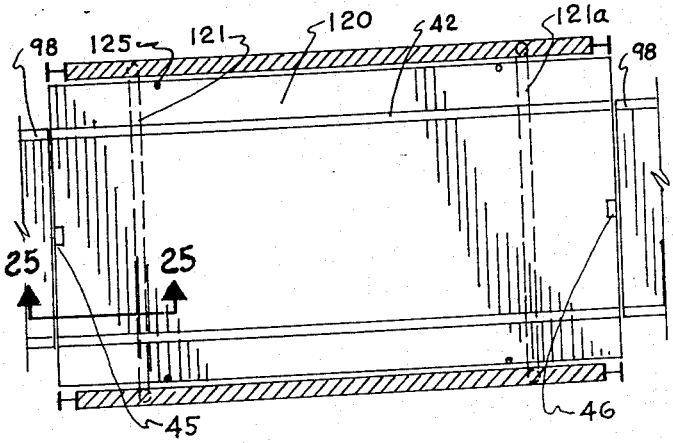

FIGS. 24 and 25 are drawings showing the transfer platform detail.

FIGS. 26*a*–26*h* are schematic drawings showing the sequence of events associated with entry and departure transfer operations.

Figure 27:
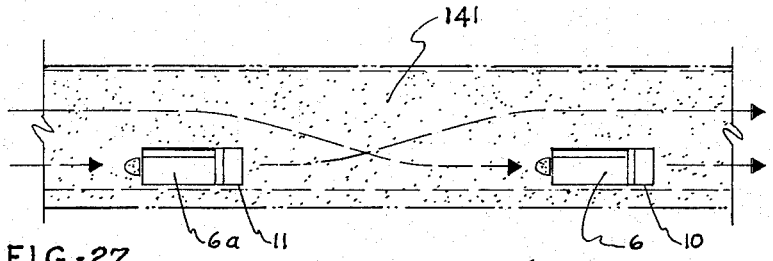
Figure 28:
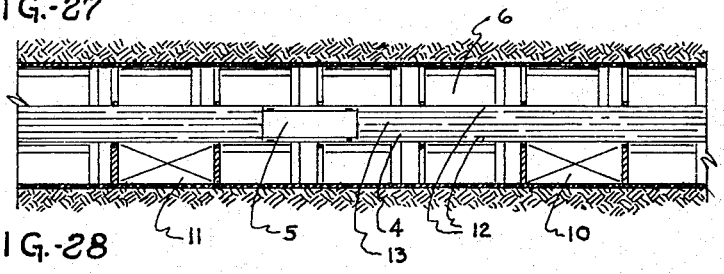

FIGS. 27 and 28 are drawings in plan view of a 25-foot lot single aisle embodiment of the invention with parallel parking underground.

Figure 29:
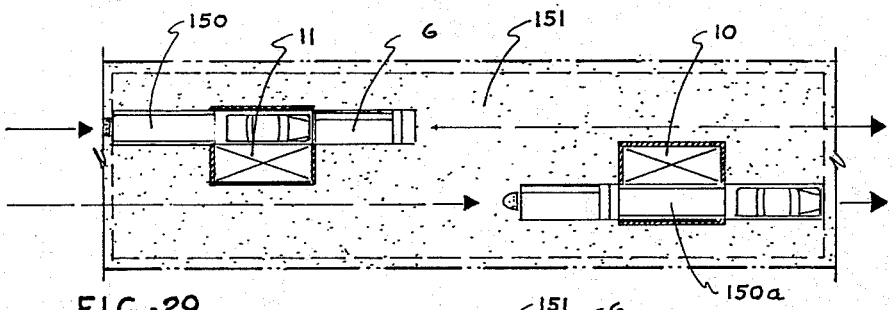
Figure 30:
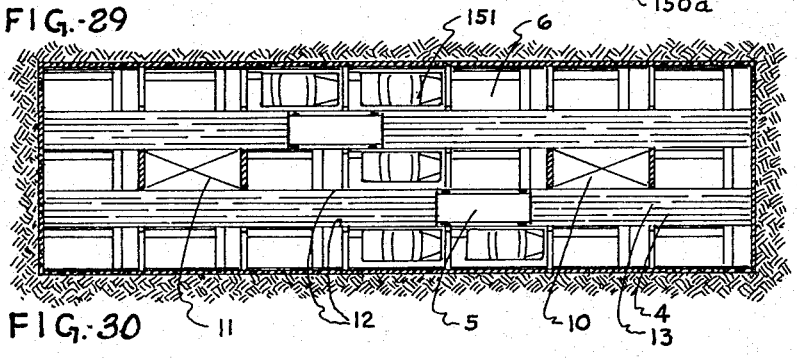

FIGS. 29 and 30 are drawings in plan view of a 40-foot lot double aisle embodiment of the invention with parallel parking underground.

FIGS. 31, 32, 33 and 34 are drawings of the cart mechanisms used in the 40-foot embodiment.

FIG. 35*a*–35*d* are diagrams of the sequence of events for elevator loading and unloading for the 40-foot double aisle embodiment.

FIGS. 36, 37, 38, 39 and 40 are drawings of the transfer means for pallet handling by the cart and elevator for the 40-foot embodiment.

FIGS. 41*a*–49*c* are sequence diagrams illustrating the steps involved in the parking and retrieval operation.

Figure 42:
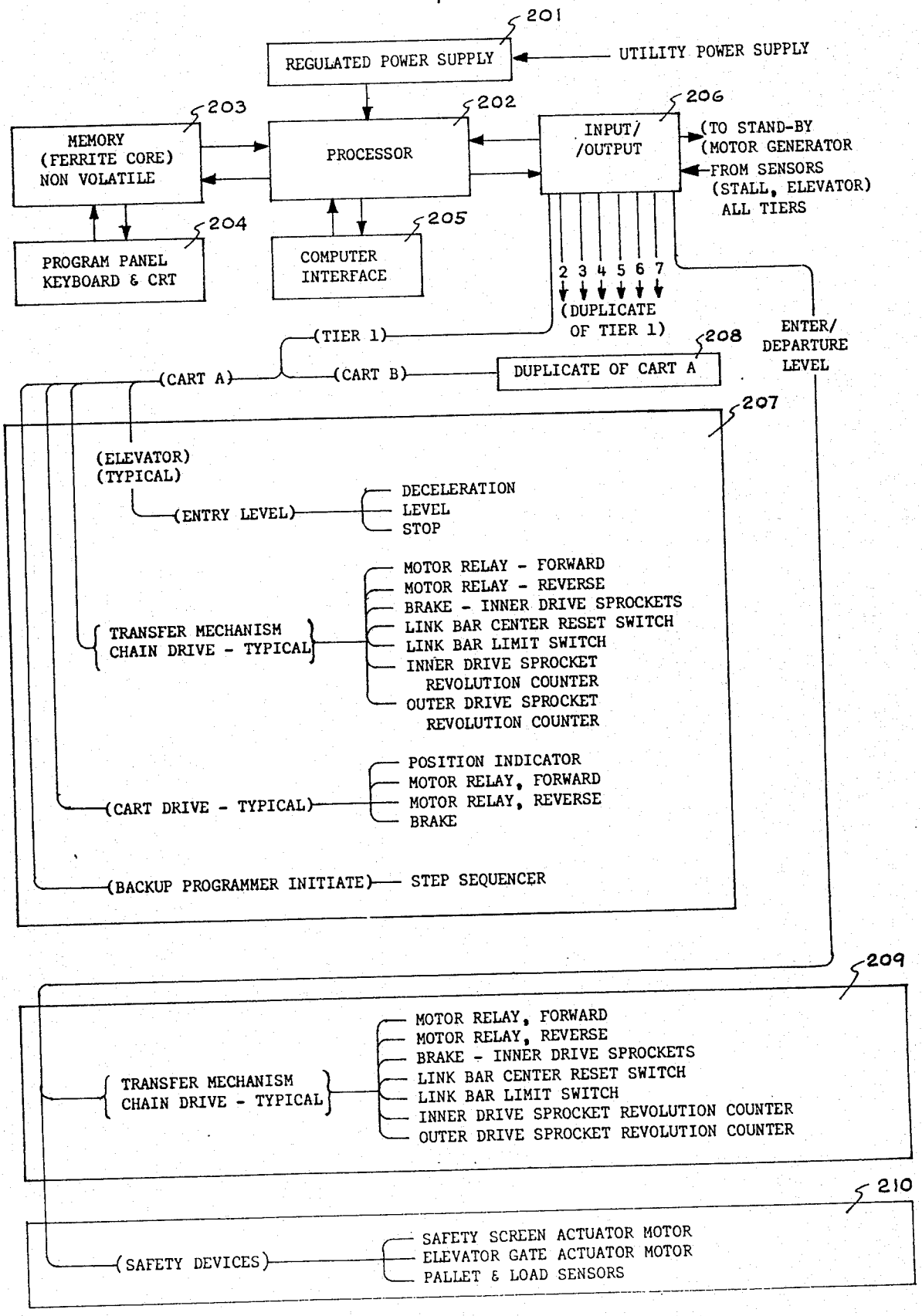

FIG. 42 is an electrical block diagram of the system.

DETAILED DESCRIPTION OF THE INVENTION

Figure 2:
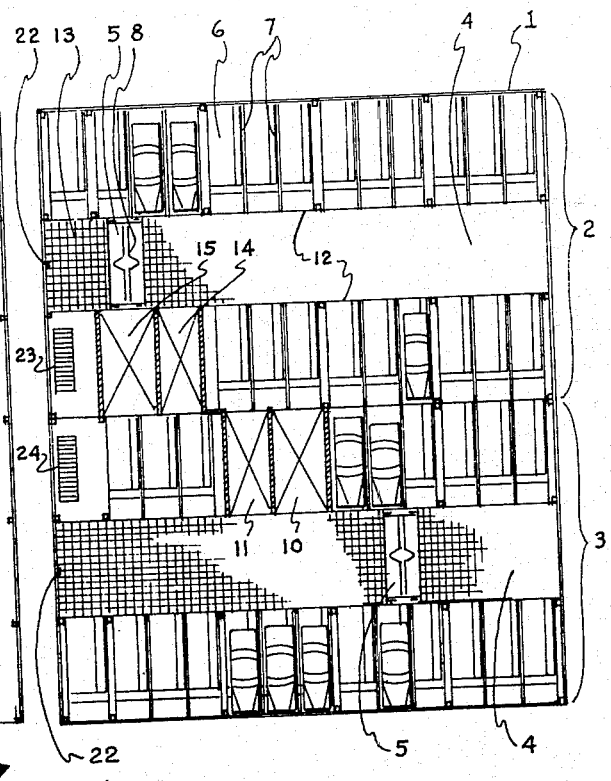
FIG. 2 is a plan view of a storage tier of a two module configuration.

Reference is now directed to FIG. 1. This figure shows the entry/deparature level. A storage tier FIG. 2 can be installed either above and/or below it. The optimum number of storage tiers is seven considering building codes for most installations. The storage tier 1 is comprised of two modules 2 and 3 in a bolted assembly having structural integrity. The modules 2, 3 each have an aisle 4 in which a bi-directionally moving cart 5 moves into alignment for storage or removal of a pallet 6 mounted on guide rails 7 such that a transfer mechanism 8 mounted on the cart 5 can remove the pallet 6 from the guide rails 7 and onto the cart 5. The cart 5 then moves into alignment with one of the elevators. There are a plurality of elevators in each module to provide sufficient redundancy to accommodate peak-hour traffic in addition to providing fault tolerance for equipment failures in service. The elevators 10, 11 on one side of the tier accommodate a cart 5*a* traveling on module 3 aisle 4 while elevators in module 2 accommodate cart 5 traveling along aisle 4 on rails 12 into alignment with elevators 14 or 15. The aisles 4 have gratings 13 to form walkways for maintenance and support for terminals 22 which provide power-and-control-cable connections to the cart. Personnel stairways 23 and 24 provide access to all tiers for maintenance.

Referring to the entry/departure level plan view, FIG. 1, it is seen that the traffic entering the storage facility can be split up into lanes *a, b, c, d* for immediate processing for storage. For example, an automobile entering at lane *d* would be driven onto a pallet in entry position 9 and then automatically moved onto elevator 10 after the passengers have disembarked from the the automobile. If, at the time of arrival of an automobile at entry position 9, the elevator 10 was in the process of storing an automobile, it would complete the storage cycle and then retrieve an automobile from the same storage tier and move it to the entry/deparature level for transfer to the outgoing lane *d'* for passenger loading and exiting. Similarly, traffic lanes *a, b, c, d* can provide a continuous stream of automobiles to elevators 10, 11, 14, 15 entry positions 16, 17, 18, 19 while claimed automobiles are departing via lanes *a', b', c', d'*. Thus it can be seen that the four elevators can accommodate the traffic providing storage and retrieval concurrently. The redundant elevators in each module provide fault tolerance for possible equipment failure. Additionally, emergency power is provided for operating the elevators in the event of power utility failure. At the storage tiers 1, backup programmers mounted on the carts 5, 5*a* are provided to program the operation of the carts 5, 5*a* and to provide backup battery power to tolerate power utility failure. Sufficient redundancy is provided in the remaining equipment to substantially preclude failure of the system due to equipment failures.

Figure 3:
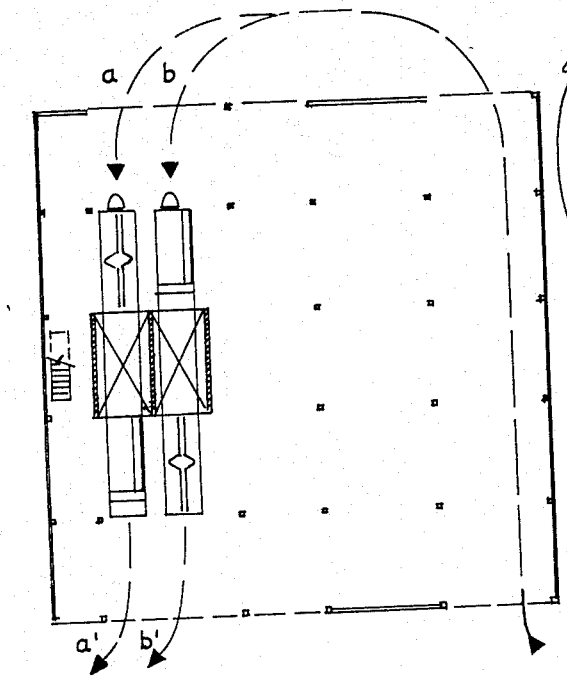
FIG. 3 is a plan view of the entry/departure level of a single module, two aisle configuration.
Figure 4:
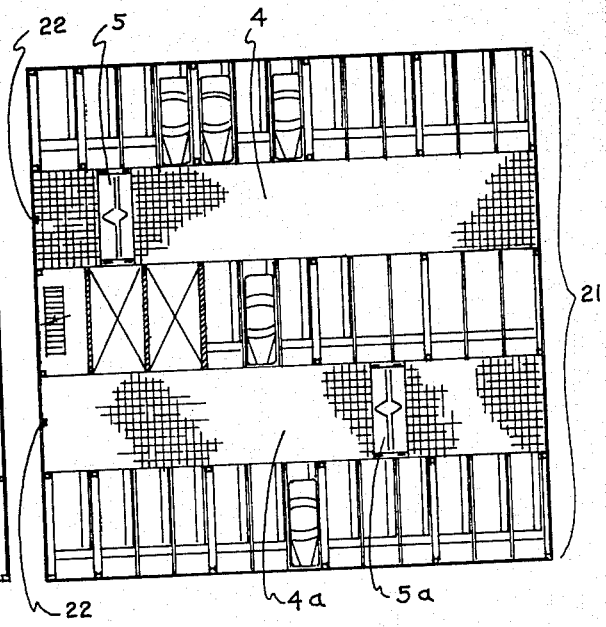
FIG. 4 is a plan view of a storage level of a single module, two aisle configuration.

Reference is now directed to the entry level FIG. 3 and a storage tier FIG. 4 for a single module alternate embodiment of the facility. Single redundant elevators and two aisles 4, 4*a* are used in this single modular structure 21 such that carts 5, 5*a* can access storage stalls and elevators in minimum time for applications of the system where the volume of storage is not as great as in the embodiment of FIG. 1, but the time for the storage/retrieval cycle is desired to be as short as possible. Power terminal boxes 22 at the ends of the aisles 4, 4*a* provide power and control signals to the cart during normal operation. In the event of power failure, the carts 5, 5*a* receive program instructions to a self-contained internal programmer from contacts at the elevator position from an auxiliary battery powered programmable controller terminal. This enables the cart to be programmed to store or retrieve an automobile under self-contained battery power. A gasoline driven motor-generator provides power for the elevators during utility power failure.

Figure 5:
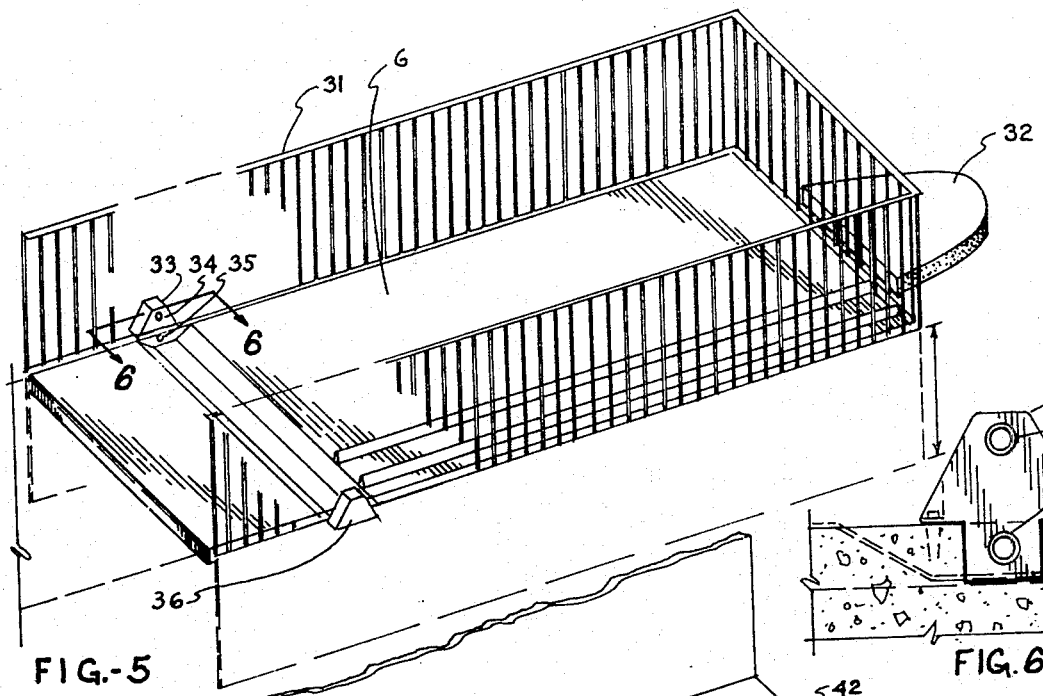
FIG. 5 is a drawing of the entry position with safety fence.
Figure 6:
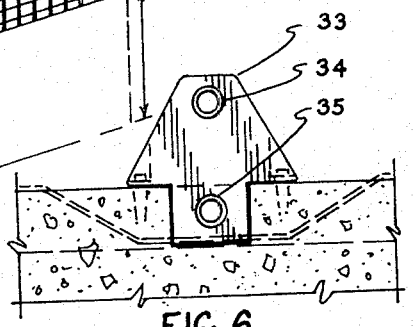
FIG. 6 is a drawing of the wheel position sensing detector.

Reference is now directed to FIG. 5. This figure shows a drawing of the entry position which includes the safety fence 31 and curb 32. Detectors 34 and 35 detect the presence of an automobile on the pallet 6, and the positioning of a pallet in the entry stall respectively, by interrupting the light beam to close the sensing circuit when there is no pallet in the entry position or when there is no automobile wheel properly positioned in the detent of the pallet 6. Light detectors 34 and 35 are housed in light sensor receptacle 33 at the edge of the entry stall. Light source 36 is at the opposite edge of the stall. Safety fence 31 is raised into position after the occupants have disembarked from the automobile. The safety fence will not raise completely if there are obstructions on the vehicle which would make it not acceptable for the parking facility. FIG. 6 shows the location of the sensing detector in relation to the wheel detent for an automobile on a pallet 6. The sensing detectors are solid state phototransistors. The light sources can be visible or infrared radiators.

Figure 7:
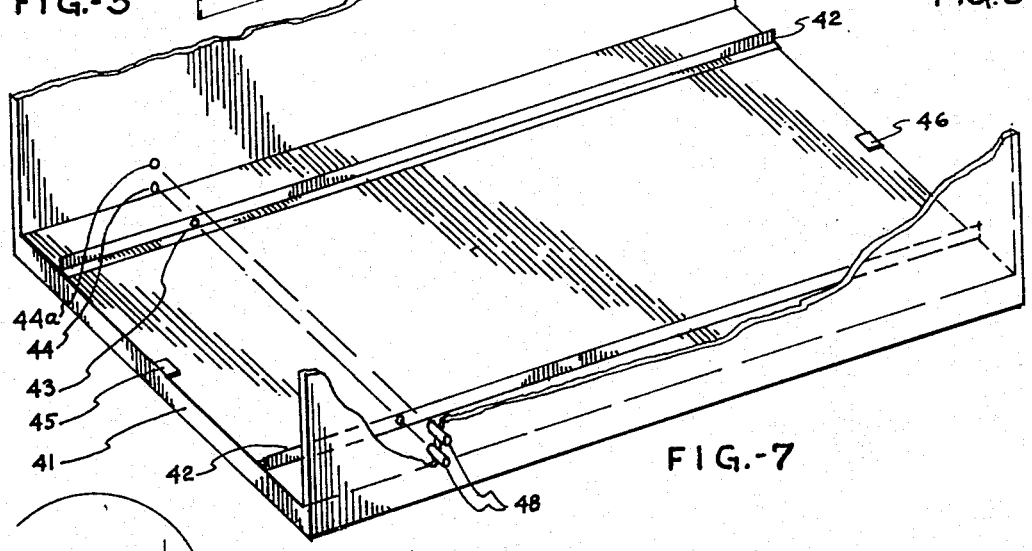
FIG. 7 is a drawing of the elevator floor showing pallet and vehicle sensors, guiding means and locking means.
Figure 9:
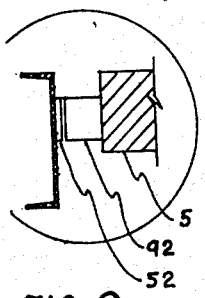
FIG. 9 is a detail drawing of the cart centering sensor.

Reference is now directed to FIG. 7. This figure illustrates the floor of an elevator such as 10, FIG. 1, showing the pair of guide rails 42 mounted on the base 41 which center the pallet 6 on the elevator and sense the presence on the elevator of a pallet, and the presence of an automobile on the pallet by means of light sources 43 through apertures 43 and 44, 44*a*. Locking lugs 45, 46 engage locking cams on the pallet to hold the pallet in position on the elevator.

Figure 8:
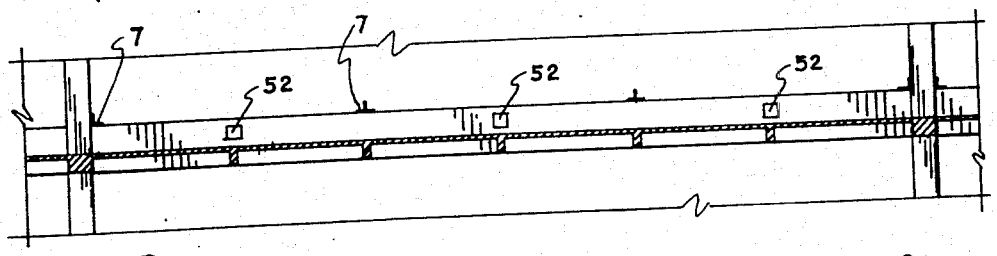
FIG. 8 is a drawing of the alignment means for centering a cart with a stall.

FIG. 8 is an illustration of a three-stall bay and means for centering the cart with a stall as the cart moves along the aisle into alignment with the stall guide rails 7. This centering means is comprised of mirror 52 and optical sensor 92 mounted on the cart 5 endwall. A photooptical detector and light source comprise the optical sensor 92 which triggers a relay in the cart drive motor circuit to interrupt the power to the motor when the optical sensor 92 is centered about the cart positioning mirror 52.

FIG. 10 provides detail of the stall occupancy sensing system wherein light sources 61 and 62 are located in line with the pallets and automobile wheels in their storage positions in the stalls as shown in FIG. 1. The light beams are collimated at and detected in each stall when there is no pallet in the stall and there is no automobile on the pallet. The beam from light source 61 is interrupted when a pallet is in a stall. The beam from source 62 is interrupted when the front wheels of an automobile are properly located in the detent in the pallet. Well known optical solid state phototransistor detector components are used for detectors 63 and 64 in each stall, and optical lens collimation is used, for light sources 61 and 62. The sensing signals are in the form of low-voltage d.c.. These signals are displayed at the central supervisor's console for monitoring the occupancy and changes of occupancy in the total facility.

Figure 11:
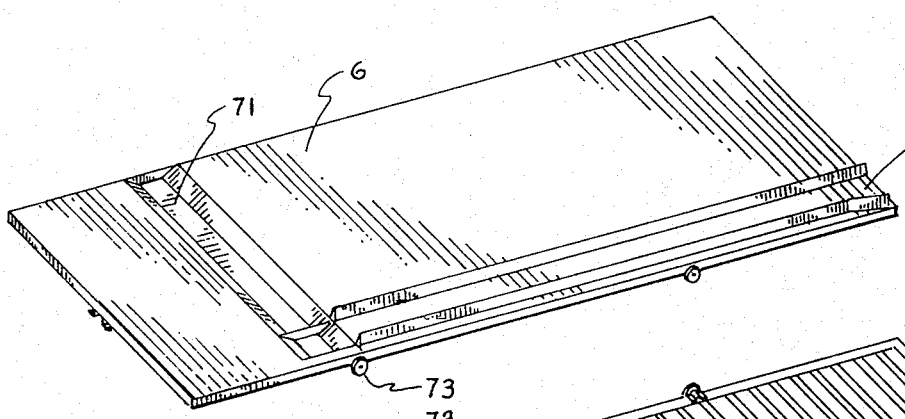
Figure 12:
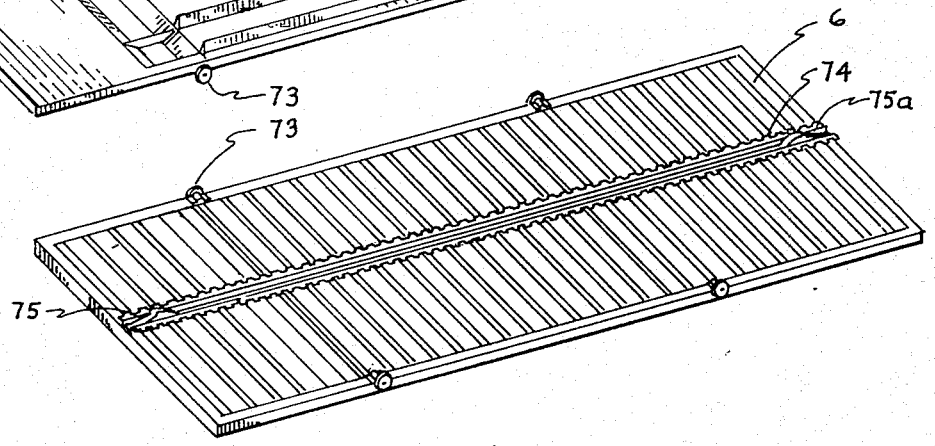
Figure 13:
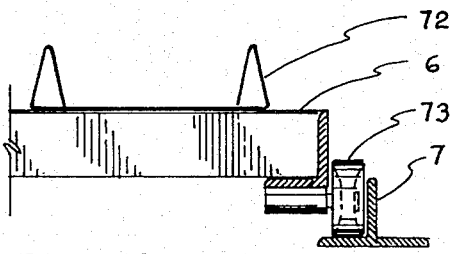
Figure 14:
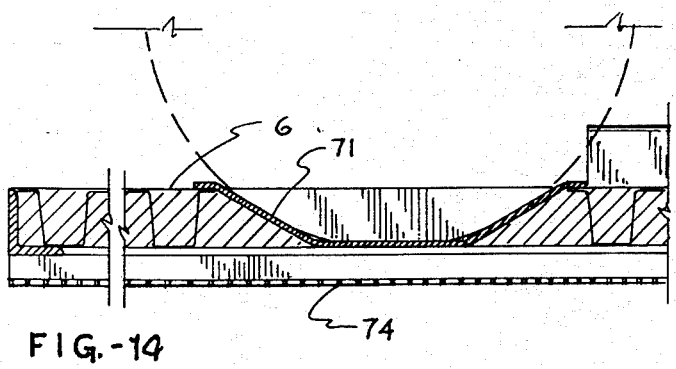
Figure 15:
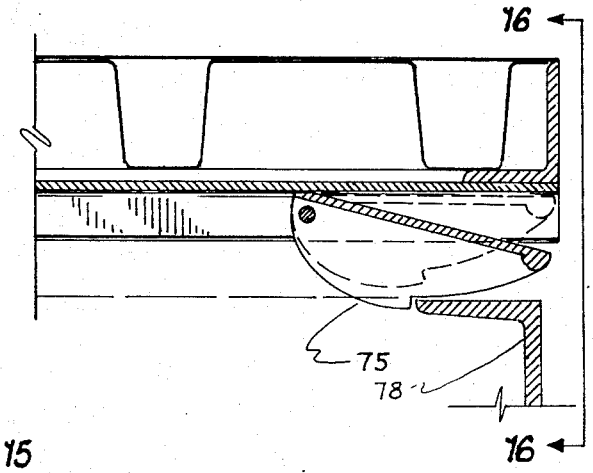
Figure 16:
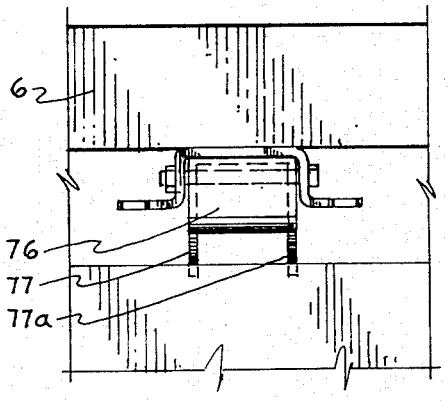

Reference is directed to FIG. 11. This figure shows a pallet in detail, the base being fabricated steel decking material having wheels 73, and a detent 71 in the top surface for retaining the front wheels of an automobile, such that the automobile front wheels, properly positioned, prevent longitudinal movement, while the left rear wheel is retained in wheel guide 72 to prevent transverse movement. As shown in FIG. 12, on the bottom of the pallet 6 is a rack-like elongated sprocket 74, spaced apart from the base and extending longitudinally at the center of the base. A locking cam 75 is mounted at the centerline near each end of the elongated sprocket 74 for locking the pallet in a stall or in an elevator such that the pallet is held in position by means of guide rails 7 as shown in FIG. 13 to prevent lateral movement of the pallet, and by locking means 75 and locking lugs 78 (FIG. 15) in each stall and plate lugs 45 and 46 in each elevator, preventing longitudinal movement. FIG. 7 d illustrates the elongated sprocket 74 spaced apart from the bottom of the pallet 6 and shows the position of the front wheels of an automobile in the detent 71 of the pallet. FIG. 15 shows the locking cam 75 and the stall locking lug 78 in the locked position. Locking lugs 78 are placed at both ends of a stall. View A—A shows the locking cam comprised of top plate 76 and side plates 77 and 77*a*.

Referring now to FIG. 17, the transfer mechanism 8 mounted on top of each cart 5 is shown in top view. The transfer mechanism 8 is used to transfer pallets from stalls to carts and from carts to elevators, and vice versa, and from input positions to elevators and from elevators to exit positions. The transfer mechanism base 80 is mounted rigidly on the top surface of the cart 5 and spaced apart therefrom, such that the sliding plates 81 and 82 can be moved in either direction to lift cam 75 of the locking means from the locking lugs 45 and 46 on the elevators or 78 in the stalls, so that the pallet can be moved from these locations onto the cart, by engaging the elongated sprocket on each pallet, with the continuous chains 89, 89*a* on the transfer mechanism 8. As shown in FIG. 17, the sliding plates 81 and 82 are connected by rigid link bar 83 and held in position laterally by four slides 84 such that the plates can move longitudinally in either direction such as is shown in the dotted extended position 86 to the left. Idler sprocket 85 connects the sliding plates 81, 82 and link bar 83 to the drive means. The drive means for the plates is by way of inner drive sprockets 87, 87*a*, outer drive sprockets 88, 88*a* which communicate power from gear means mounted on the bottom of base 80, through continuous chains 89 and 89*a*. It can be seen that a differential speed of rotation of sprocket 88 with respect to 87 will cause continuous chain 89 to be elongated to the left or to the right of the transfer mechanism thus moving the sliding plates 81, 82 in either direction. Similarly, a differential speed of sprockets 87*a* and 88*a* will cause continuous chain 89*a* to be elongated to the left or the right. Since sprockets 88 and 88*a* and 87 and 87*a* are driven symmetrically, continuous chains 89 and 89*a* move in unison to engage elongated sprocket 74 on a pallet and move it symmetrically over the transfer mechanism base 80. This is the normal position for a pallet on a cart. Sliding plate 81 or 82 must unlock the pallet from its normal position in a stall or on an elevator before it can be moved by the transfer mechanism. The limit of travel of the sliding plate assembly, which includes the sliding plates 81, 82, and link bar 83, is defined by grooves 91*a*, 91*b*, engaging the cam lever on double pole-double throw limit switch 90. This switch energizes the brake solenoid 117, to force the brake lever 105 and brake shoe 107 against the braking surface of gear 104 stopping the inner sprockets 87, 87*a*, from rotating and causing the continuous chains 89, 89*a* to unwind from the elongated sprocket 74 on the pallet 6, and causing the sliding plate assembly to retract to its normal position centered on cart 5. When the sliding plate assembly is centered, the cam lever of switch 90 engages cam surface 91 on closing a second circuit that resets a pair of electrical counters 115, 116 shown in FIG. 20, FIG. 21 and FIG. 22.

Referring now to FIG. 18 reveals the mounting of the transfer mechanism 8 on a cart 5 and a pallet 6 mounted on the transfer mechanism 8. This figure also shows the cart 5 movably mounted on rails 12 and powered by electric motor 93 through gear means 94 enabling the cart 5 to move along the rails 12 to a centering position defined by the cart positioning stall sensor 52 in combination with photooptical detector 92 which positions the cart in alignment with a stall and interrupts power to the motor 93 to stop the cart. As the cart moves along the aisle 4, it rolls up or unwinds the power and control signal cable 48 on the reel 47 which is driven from the motor 93 power train. Wheels 95 on each corner of the cart 5 are driven in either direction by motor 93. Wheels 73 on each pallet roll on rails 98, 98*a* along the edges of the cart 5 as it engages the elongated sprocket 74 of the pallet, after the locking cam has been moved up by sliding plate 81 or 82.

FIG. 19 is a bottom view of a cart 5 showing the drive motor 93 and the control cable 48 on reel 47. The power and control signals for the cart which include instructions for; the motor 93, the optical sensor 92 and sequence initialization to the backup programmer 50 to keep it sequenced to the proper operational step performed in the normal operating mode. In the event of cable failure, programmer 50 is automatically switched to the "operate" mode when relay 49 is deenergized by the fault, such that programmer 50 controls the sequence of operation of the cart and transfer mechanism, in accordance with a fixed program hardwired into the programmer 50. This enables the cart and transfer mechanism to complete a storage/retrieval cycle and return to the elevator position for further instruction in a robotic manner. Contact terminals 51 for the programmer 50 are mounted on the side of the cart 5 and automatically engage contacts at the elevator position, to which the cart always returns when not in cycle. At this position, the programmer 50 can then be reinstructed for additional storage or retrieval cycles. Programmer 50 is comprised of well known stepping switch functions sequentially enabled by the receipt of electrical signals from the cart position sensor 92 and the transfer mechanism sliding plate position counters 115, 116 or limit switches 90.

Reference is now directed to FIG. 20. This figure shows the drive means for the continuous chains 89 and 89*a* on the transfer mechanism. On the underside of the transfer mechanism is a motor and gearing which operate as follows. Drive gear 101 transfers power from motor 100 to drive gears 109, 109*a* by their common shaft on which spur gear 102 is positioned to engage gear 101. This imparts rotary motion to outer sprockets 88, 88*a* in counter rotating directions. Planetary gear 103 imparts power to gear 104 when the brake solenoid 117 holds lever 105 and brake shoe 107 against brake disk 106 to keep it from rotating such that planetary gear 103 transmits rotary motion from gear 101 to gear 104, and spool gear 108, which in turn moves drive sprockets 87 and 87*a*, in counter-rotating directions. The rotational speed of drive sprockets 87, 87*a* is 1.2 times the speed of rotation of drive sprockets 88 and 88*a*. The resulting differential speed of sprockets 87, 87*a* with respect to 88 and 88*a*, causes the elongation or retraction of the continuous chains 89, 89*a* in one direction and moves the sliding plates 81, 82 in that direction since idler sprockets 85 are pivoted thereon. The movement of the sliding plates is approximately two feet. Reversing of the electrical motor 100 causes the motion of the sliding plates 81, 82, and the link bar 83 to move in the opposite direction from the normal centered position.

When brake lever 105 forces brake shoe 107 against gear 104, this gear is held stationary such that sprockets 87, 87*a* cannot rotate. Planetary gear 103 then orbits around the beveled gear sections of gears 101 and 104. Planetary gear 103 is pinned to the axle-and-disk member 106 which rotates with it when not braked.

When sprockets 87, 87*a* are held stationary, as in a pallet retrieval sequence, the continuous chains 89, 89*a* cause the sliding plate assembly to move rapidly to its extended position under a pallet, simultaneously unlocking the pallet, and rolling the continuous chains 89, 89*a* onto the teeth of the elongated sprocket 74. At this extended position, 1/10 the length of a pallet, brake lever 105 forces shoe 107 against disk 106 causing the inside sprockets 87, 87*a* to revert to the differential speed mode and rotate at the differential speed 1.2 times the speed of sprockets 88, 89*a*. This differential speed causes the pallet to be pulled by the elongated sprocket 74 onto the transfer mechanism at a speed 10 times the rate at which the sliding plate assembly is retracted, such that when the pallet is centered on the transfer mechanism the sliding plate assembly is completely retracted.

Counter 116 counts the outer sprocket revolutions, indicating the distance that the sliding plate assembly has extended in one direction, returning to zero at the center position. Counter 115 counts the revolutions of the inner sprocket which is proportional to the distance the pallet is moved by the transfer mechanism. When the pallet is centered on the transfer mechanism, the counters 115 and 116 are reset to zero. A specific count is used to indicate the limit of extension at which the brake system is actuated in the storage sequence, or the brake is released in the retrieval sequence. These signals are processed by the programmable controller to actuate the brake and motor functions.

FIG. 23 illustrates the storage/retrieval sequences. This figure is a partiale vertical section through a typical single aisle multi-level structure as shown in FIG. 1. The transfer mechanism 8 is indicated at grade on the entry side, and the transfer mechanism 8*a* on the departure side, with elevator 10 between the two. Beneath the elevator 10 is the transfer platform 120 in the depressed position in the elevator pit 123 such that the elevator floor aligns with the rails 98 on the transfer mechanism 8. A plan view of the transfer platform 120, located immediately under the elevator, is shown in FIG. 24. An incoming automobile drives onto a pallet 6 on the transfer mechanism 8 and the pallet 6 is transferred to the elevator 10. The elevator moves to the tier of the designated stall where a cart in the aisle 4 transfers the pallet 6 into the designated stall. In the retrieval sequence, the cart removes a requested pallet from its stall, moves it to an elevator 10 which moves it to the entry level. The pallet and automobile are transferred off the elevator to the deparature area by transfer mechanism 8*a* on the departure side.

FIG. 24 illustrates the plan of the transfer platform which is a necessary provision to allow proper timing for the passengers to receive an automobile on the deparature side and drive away without interfering with the operation of the elevator. When the elevator rises to take an empty or loaded pallet to a tier above it, the transfer platform 120 is automatically raised to the transfer mechanism level and locked into position to allow the transfer of a pallet from the departure side to the entry side, allowing another automobile to come to the entry position. The transfer platform 120 is supported by two beams 121, 121*a*. Pins 125 allow pressure from the elevator 10 to release a pawl 124 shown in FIG. 25.

FIG. 25 is a partial section showing the transfer platform 120 at the end location of the locking lug 45 and the location of the pawl release pin 125. Lugs 45, 46 engage the locking cams 75 on each end of a pallet to lock it on the elevator. The pawl 124 engages a hole in the cross beam 121 which is supported at each end by springs 122. The four springs 122, supporting the beams 121, 121*a* are recessed in chases of the elevator pit 123. The vertical arrows show the travel of the transfer platform when it is depressed by the weight of the elevator to the distance required to put the rails on the floor of the elevator in line with the transfer mechanism rails both on the entry and departure sides.

FIG. 26 is an illustration of the sequence of events associated with entry and departure transfer operations. This figure shows the inherent speed of the system. FIG. 26*a* shows a loaded pallet on the entry side of elevator 10, a loaded pallet on the elevator 10 and an empty transfer mechanism in the departure area. FIG. 26*b* shows a loaded pallet from the elevator transferred to the deparature area. FIG. 26*c* shows the loaded pallet from the entry area transferred to the elevator 10. FIG. 26*d* shows the elevator risen from the entry level, with the transfer platform 120 moved simultaneously into place. FIG. 26*e* shows that the automobile on the pallet in the departure area had departed. FIG. 26*f* shows the empty pallet from the departure area transferred to the transfer platform 120. FIG. 26*g* shows the empty pallet transferred from the transfer platform 120 to the entry position. FIG. 26*h* shows another automobile has arrived on the pallet in the entry position. FIG. 26*a* shows the elevator has arrived at the entry level with a car ready for departure. FIG. 26*b* shows a loaded pallet from elevator 10 transferred to the departure area. The sequence is repetitive. The transfer mechanisms 8, 8*a* are the same transfer mechanisms as shown in FIG. 17 except that they are fixed in the entry/departure slab. In all cases when the elevator is bringing a pallet to the entry level, transfer mechanism 8*a* transfers it from the elevator 10 to the departure side whether it is loaded or unloaded, and secondly the pallet at the entry side is transferred by the transfer mechanism 8 to elevator 10. Thirdly, that pallet is transferred by transfer mechanism 8 to the entry side so that, in summary, the sequence of the elevator in all cases, when arriving at the entry level, is to transfer a pallet to the departure side and to pick up a pallet from the entry side. The time to transfer a pallet from the elevator to the departure side or to transfer a pallet from the entry side to the elevator requires only 4 to 5 seconds for each transfer.

FIG. 27 is a plan view of a 25-foot lot, single aisle parallel parking underground embodiment of the invention. This configuration was devised to provide parking in narrow lots in concentrated urban areas. Elevator 10 and elevator 11 support pallets 6 and 6*a*. The dotted lines with arrows show the traffic pattern as planned assuming access from the street onto the paved surface 141 and to exit, either to another street or an alley. The traffic pattern allows both elevators 10, 11 to accept automobiles for storage and to allow automobiles to depart from each of them. Two elevators are required for redundancy and to provide speed. The elevators are separated by three stall lengths, for two reasons — one, to allow adequate turning radius for automobiles entering and departing, and two, to provide space on the immediate first tier under the paving 141, for the elevator mechanisms, auxiliary power, and control mechanisms for the operation of the entire system.

FIG. 28*b* is a typical tier plan showing the location of the aisle 4 with a cart 5 running on rails 12 which allows the movement of the cart between the elevators and the ability to place pallets 6 in any stall on either side of the aisle. In constructing this configuration, the hole would be dug in a manner whereby the cross bracing for lateral support would be the final structure which supports the rails for the pallet in each stall and the vertical support for the tiers. At the completion of the excavation, the cross bracing laterally and longitudinally would be the final structure. The elevators used in this configuration have a unique requirement, the elevator platform is required to be supported on legs extending below the platform. The cables are attached to the legs at a point below the platform so that when the platform is leveled with the top of the paving 141, the platform is above the top of the cable drums. This configuration is assumed to be eight stalls long, six tiers deep, and having a capacity of 81 cars.

FIG. 29 is a plan view of a 40-foot lot two-aisle embodiment of the invention with parallel parking underground. This configuration is designed to make a maximum use of a standard 40-foot lot. The traffic pattern is shown in dotted line assuming street access and egress as in FIG. 27. An automobile would enter to the entry areas of either elevator 10 or 11 and the people would be able to disembark from both sides. The traffic pattern, and ease with which automobiles can be stored and retrieved, is permitted by an additional transfer mechanism which is illustrated is subsequent figures.

Figure 31:
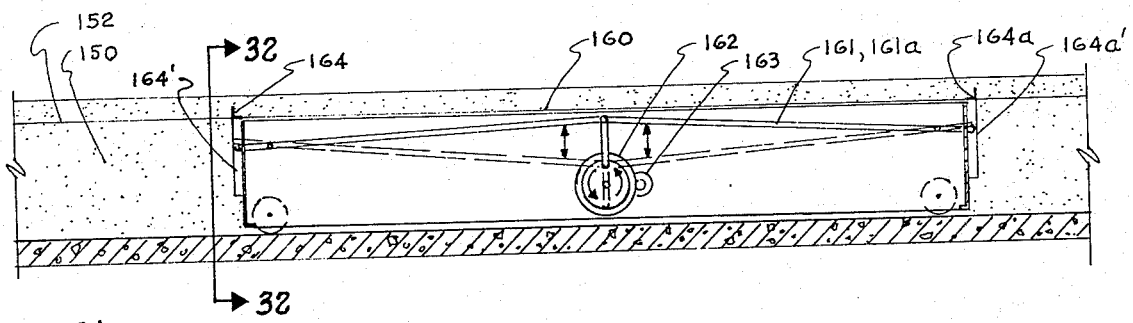
Figure 32:
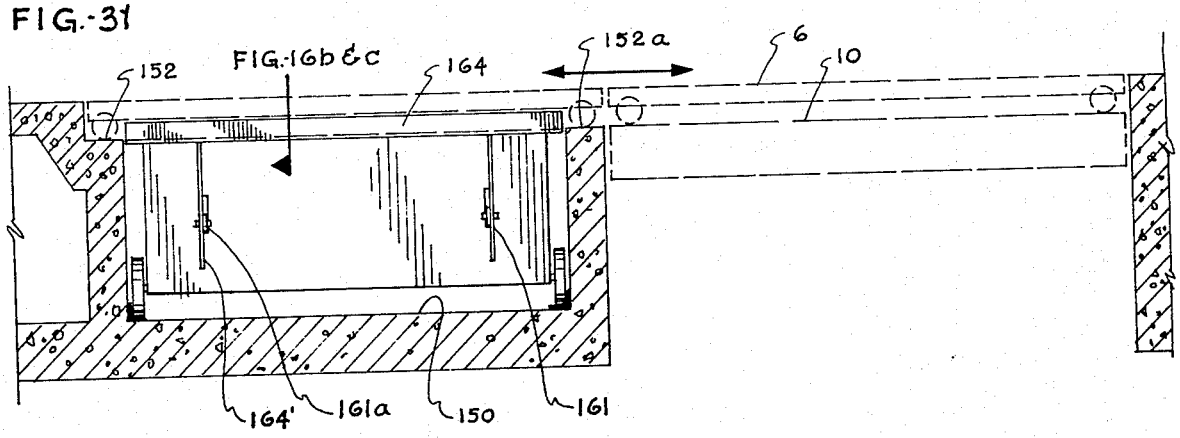

FIG. 31 demonstrates a shuttle cart 160 operating in a pit which connects an entry area and a departure area in FIG. 29. The cart 160 shuttles to three positions, the entry area, the elevator position, and the departure area. The cart 160 is on wheels, powered by a motor, and is controlled in the same manner as a cart 5. The cart 160 has rails 164, 164*a* over which a pallet, loaded or unloaded is transferred when at the elevator station to the two shoulder 152, 152*a* of the pit 150 which extends from the entry area to the departure area. These rails 164, 164*a* are on raisable beams 161, 161*a* and are raised to a level position with the shoulders by a motor and wheels 162, 163. The function is that the rails 164, 164*a* are level with the shoulders when in the lowered position. The mechanism 162 raises the rails lifting the pallet. The cart then goes to the departure position and the pallet is deposited on the shoulders 152, 152*a*. The shuttle cart then moves to the entry area underneath the pallet that is resting there, picks it up and shuttles to the elevator area where it lowers the rails and deposits the pallet. The transfer mechanism on the elevator will transfer it from that position onto the elevator. FIG. 32 illustrates the arms that support the rails 164, 164*a*. This illustration indicates the cart being in the elevator position and the dotted lines outlining a pallet 6 indicate the position of the wheels of a pallet when in location on the shoulders of the pit in which the cart shuttles.

Figure 33:
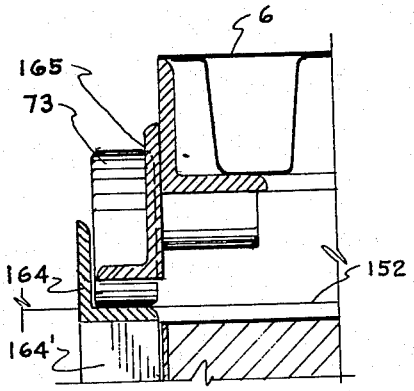

FIG. 33 shows the addition to this configuration necessary on each pallet of an angle which is attached at each end between the wheels of a pallet. When the rails 164 are raised to engage this angle 165 the pallet is raised and the pallet wheels are no longer in contact with the shoulders 152, 152*a*. The pallet is then free to be moved by the cart.

Figure 34:
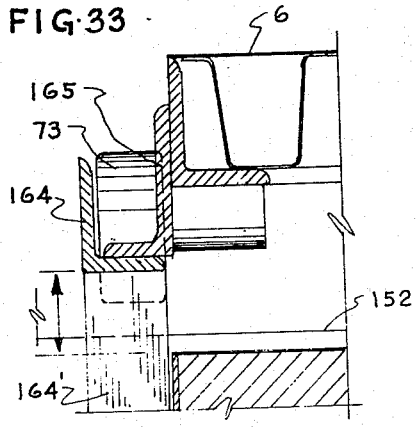

FIG. 34 illustrates with arrows the travel of the rail 164 as affored by the uplift of the supporting members 164, 164', which lifts the pallet wheels off the shoulder of the pit and allows the cart to shuttle it to a new position.

Figure 35A:
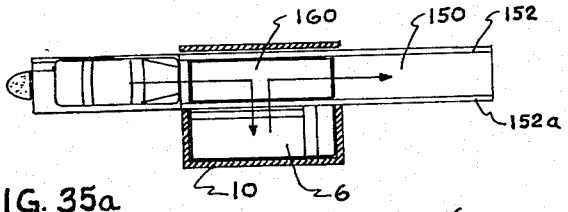

FIG. 35*a* illustrates the sequence of the pallet movement when an elevator comes to the entry level. Elevator 10 transfers pallet 6 onto the shuttle cart 160 in the shuttle pit 150 with the arrows showing that the shuttle cart moves the pallet to the departure area. Then the shuttle cart moves to get the loaded pallet at the entry area and takes it to the elevator station. The loaded pallet is then transferred to the elevator.

Figure 35B:
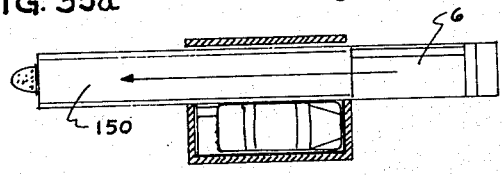

FIG. 35*b* shows the pallet being shuttled from the departure area to the entry area and the loaded pallet already placed on the elevator.

Figure 35C:
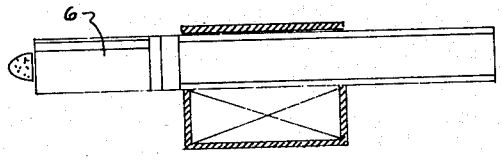

FIG. 35*c* indicates that the elevator has departed; the empty pallet is in the entry area and ready to receive.

Figure 35D:
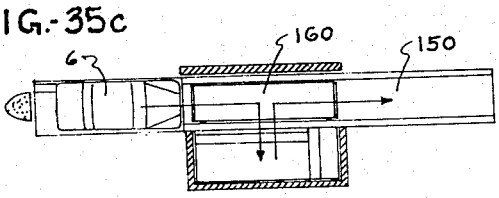

FIG. 35*d* again shows a car on the pallet at the entry area, and the sequence of taking the pallet off the elevator to the departure area and the shuttle going back taking the loaded pallet from the entry area to the elevator station and being transferred onto the elevator. FIG. 35*d* is a repeat of FIG. 35*a*.

Figure 36:
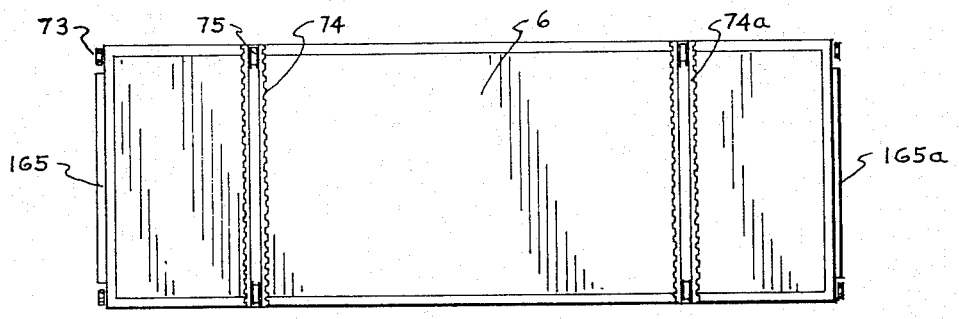

The transfer system as illustrated in FIG. 36*a* requires changes in the pallets, carts and elevators as illustrated in FIGS. 36, 37, 38, 39, and 40.

FIG. 36 illustrates the underside of a typical parallel parking pallet with two elongated sprockets 74, 74*a*. These pallets have lift rails 165, 165*a* and wheels 73 mounted on the ends.

Figure 37:
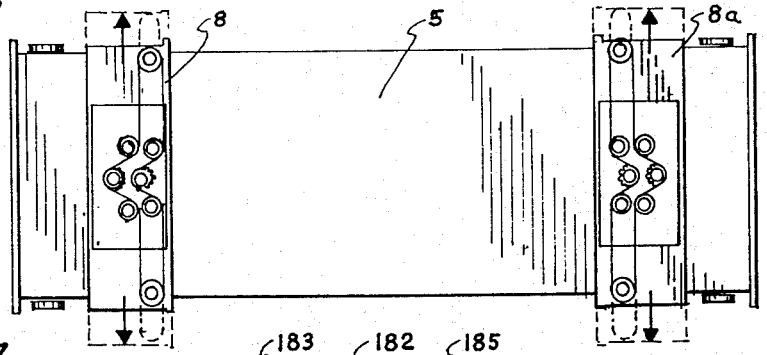

FIG. 37 illustrates the configuration of the transfer mechanisms on a parallel parking cart 5 with transfer mechanisms divided to ride on each side of elongated sprockets 74, 74*a* on the bottom of the parallel parking pallet. The transfer mechanisms operate in a manner similar to the mechanism of FIG. 17, but require no more movement that is indicated by the arrows pointing in both directions. In FIG. 37, the transfer mechanism engages the elongated sprockets 74, 74*a* outside teeth.

Figure 38:
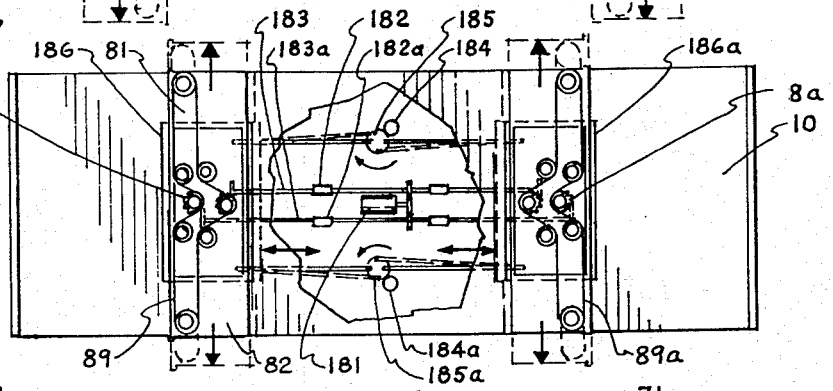

In FIG. 38, the elevator 10 in this configuration also has transfer mechanisms divided to engage the inside teeth of the racks elongated sprockets 74, 74*a* on the bottom of the pallet 6. At the tier where the carts transfer pallets on the elevator, the transfer mechanisms on the elevator are placed in a contracted position to avoid engagement of the inner teeth of the elongated sprockets 74, 74*a* as the pallet is being transferred onto the elevators. As soon as the transfer from the cart to the elevator has been completed, the transfer mechanisms on the elevators are placed in a position to engage the inner teeth of sprockets 74, 74*a*, holding them in secure position while the elevator moves in its vertical motion. When the elevator has taken a pallet to the entry/departure level, the transfer mechanism on the elevator is able to transfer the pallet across the shuttle cart 160 to a position with the wheels of the pallet resting on the shoulders 152, 152*a* of the shuttle pit 150 FIG. 31. The transfer mechanism on the elevator provides the same entry/departure sequence that applies to FIG. 1.

The duplex transfer mechanisms 8, 8*a* are driven synchronously by a motor 181 by means of splined drive shafts 183, 183*a*. In the contracted position referred to above, the motor 181 is stopped and the drive shafts 183, 183*a* are shortened within the splined couplers 182, 182*a*. This shortening is accomplished by a pair of rotating cams with followers attached to plates 186, 186*a* driven by motors 184, 184*a*. The action of these cams causes plates 186, 186*a* with transfer mechanisms 8, 8*a* mounted on those plates, to be contracted a sufficient distance to enable the transfer chains 89, 89*a* to clear the inside teeth of the elongated sprockets 74, 74*a*. When a pallet 6 has been transferred from the cart FIG. 37 to the elevator FIG. 38, the rotating cams 185, 185*a* expand the plates 186, 186*a* such that the transfer mechanism chains 89, 89*a* engage the inside teeth of the elongated sprockets 74, 74*a*. Mounted on plates 186, 186*a* are sliding plates 81, 82 integrally joined by arms from the same plate stock. These plates perform the function as in FIG. 17 to transport the chains 89, 89*a* to engagement with the elongated sprockets 74, 74*a*.

Figure 39:
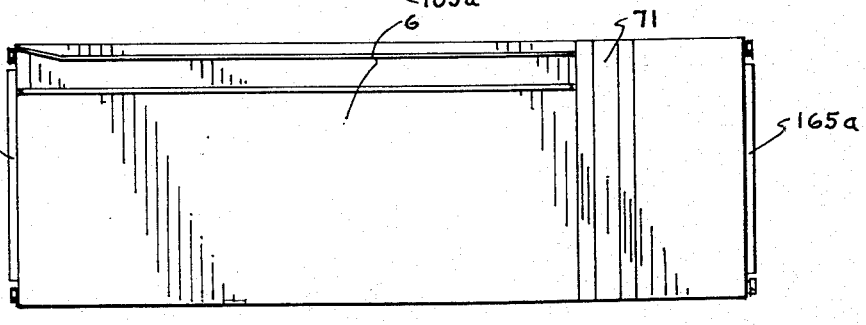

FIG. 39 illustrates the top surface of a typical parking pallet 6 showing the lift rails 165, 165*a* at each end.

Figure 40:
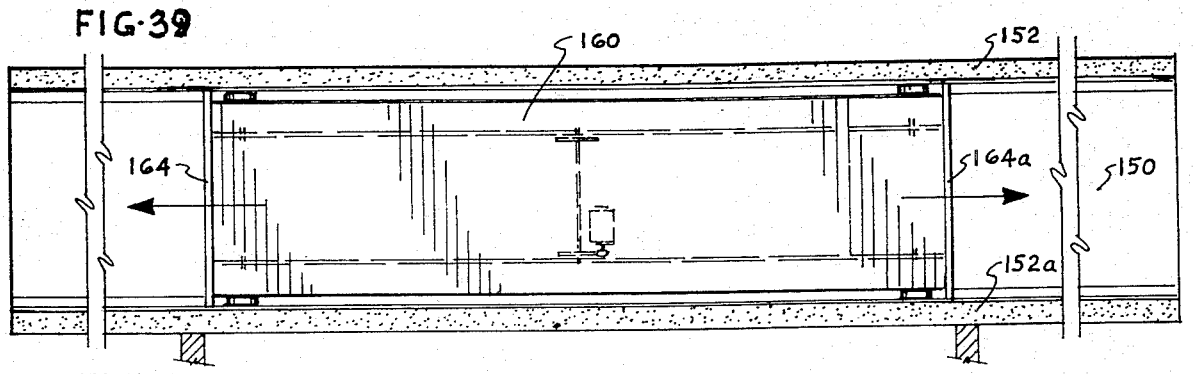

FIG. 40 shows the shuttle cart 160 with arrows indicating how it travels from the elevator position where it is illustrated, to the entry or departure positions.

Figure 41B:
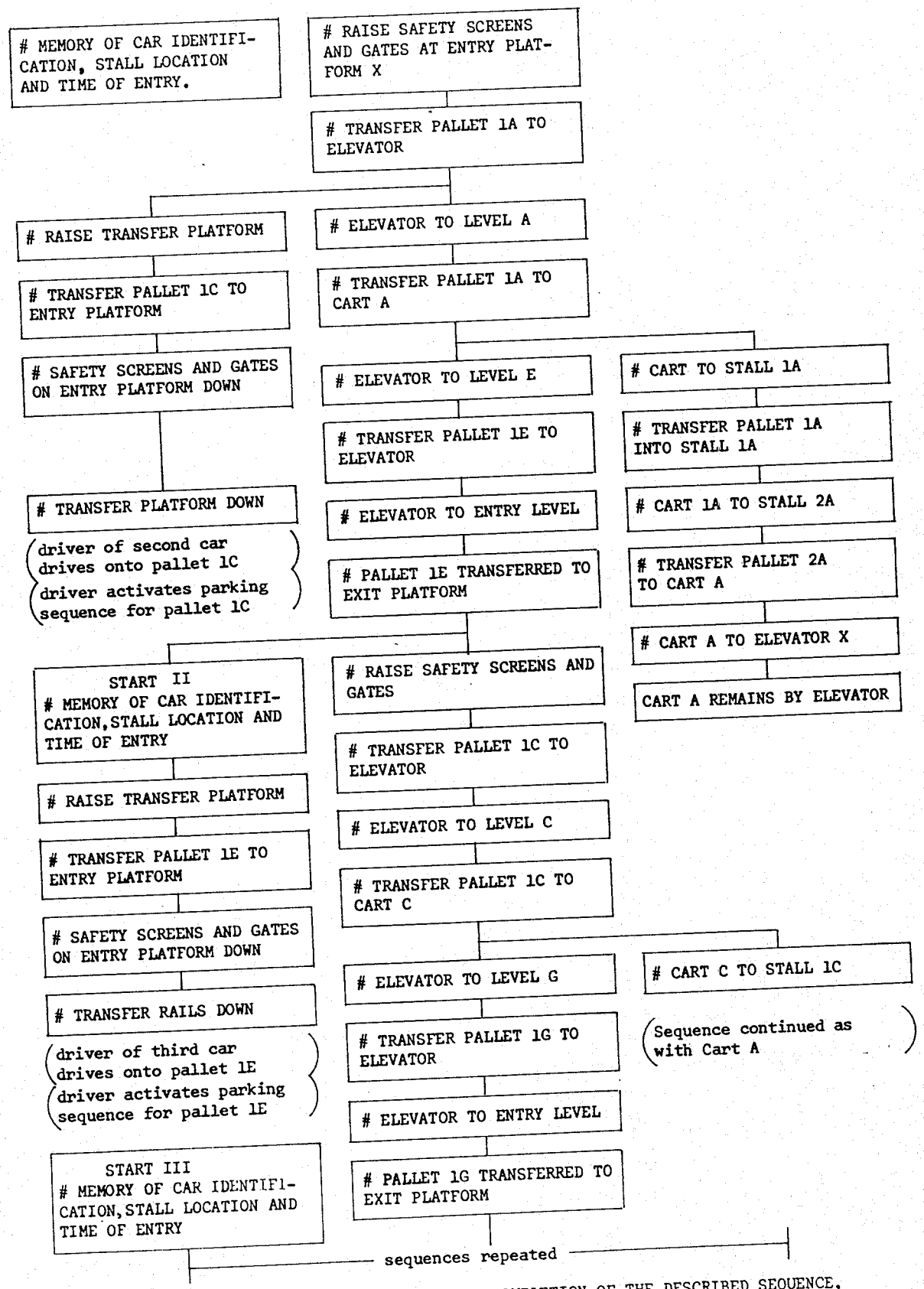

FIG. 41 is a diagram shown on three plates of the operational steps involved in: the entry and storage sequence; and the retrieval and exiting sequence. The elevator sequence of events proceeds down the center of the page. Branches to the left and right of this central column indicate events concurrent with the events in the center column.

FIG. 42 is the electrical diagram of the system. The regulated power supply 201 receives utility power at 115v, 60 HZ from the power lines in the normal mode of operation. In the fault-tolerant mode, power supply 201 receives power from a gasoline powered motor/-generator set. The fault/tolerant mode is signaled through the input/output circuits by the processor 202 when the power from the regulated supply 201 fails. The processor 202 performs the logic functions of comparison, and counting and controls storage and retrieval of data in the memory 203. A program keyboard 204, having a cathode ray tube (CRT) display, enables a supervisor to interact with the program when desired such that alterations in the normal sequence can be made based upon an anomalous condition displayed on the CRT display. The keyboard instructions set up logic functions in the processor 202 to alter the input/output circuits. Computer interface circuits 205 enable the connection to the storage charge computer. This charge is computed on the length of time the car was stored times a rate factor. All seven storage tiers and the entry/departure level apparatuses communicate with the control processer 202 through the input/output circuits 206. The electrical signals associated with a cart (cart A) are shown in block 207. In the seven tier, two aisle facility under consideration, there are two carts per tier. Cart B, 208 signals are the same as those of cart A. The entry/departure level signals to the transfer mechanisms are shown in block 209. Signals from the safety devices 210 at the entry/departure level control the programming of the transfer mechanisms and can be displayed on the CRT display of the program panel 204. Switching sequences or "ladder" displays are also displayed as they occur on the CRT display, giving the supervisor a continuous check on the facility operation and status.

What is claimed is:

1. A storage system which comprises in combination:

a storage structure having a plurality of tiers and an entry/departure level;

a plurality of framed areas defining stalls on each tier, for storage;

at least a first pair of rails on each parking tier extending transversely of said stalls;

an elevator shaft extending through said parking tiers, an elevator having an elevator platform for movement in said shaft to a rest position at the entry/departure level and at each parking tier;

a transfer platform resiliently mounted in said elevator shaft under said elevator platform, adapted to move up and down a distance equal to the depth of said elevator platform, and adapted to be moved by said elevator platform when at said entry/departure level, and to provide a level surface replacing said elevator platform when moved from said entry/departure level;

a plurality of pallets provided with rollers for movement in either direction along one axis on said elevator, in said stalls, or on said transfer platform, and having an elongated sprocket mounted on the bottom along the axis;

a cart movable on said rails adjacent said elevator and said stalls, adapted to hold said pallets;

transfer means mounted on said cart adapted to engage said elongated sprocket on said pallets and to move said pallets onto and off of said cart;

a first motor means on said cart for moving said cart along said rails;

a second motor means for moving said elevator platform in said elevator shaft;

a first sensing means for sensing the position of said cart on said rails;

a second sensing means for detecting the position of said elevator platform;

a third sensing means for detecting the position of said pallets in said stalls;

a fourth sensing means for detecting the presence of a vehicle on said pallet; and, sequencing means electically connected to said four sensing means, to said two motor means, and to said transfer means for controlling the sequence of operation of said motor means upon the receipt of signals from said sensing means or an override signal manually entered into said sequencing means;

whereby a pallet carrying a vehicle is transferred onto said elevator and moved to one of said tiers by said elevator and transferred from said elevator to said cart by said transfer means and transported on said cart to one of said stalls and transferred by said transfer means from said cart into said stall, and vice versa, being monitored by said four sensing means and said sequencing means, and controlled by said sequencing means.

2. A storage system as defined in claim 1 wherein said transfer means comprises:

a base, substantially rectangular, having a top, bottom, and four sides, adapted to be mounted on the top surface of said cart above the surface;

a plurality of supports mounted on the bottom of said base, adapted to space said base above the top surface of said cart;

à first group of idler sprockets arranged substantially in two lines near the center of said base of the top thereof;

a second group of idler sprockets arranged substantially in two lines near the center of said base on the top, and symmetrically located with said first group of idler sprockets;

a first pair of drive sprockets mounted on said base adjacent said first group of idler sprockets;

a second pair of drive sprockets mounted on said base adjacent said second group of idler sprockets;

a first continuous chain rotatably engaging said first group of idler sprockets and said first drive sprocket in a reference direction;

a second continuous chain rotatably engaging said second group of idler sprockets and said second drive sprocket in a direction opposite to the reference direction;

a plurality of chain guides mounted on said base contiguous with said first and second cntinuous chains, adapted to prevent transverse sagging of said chains;

a first sliding plate slidably mounted on said base near the end thereof along the longitudinal dimension and having an idler sprocket mounted thereon engaging said first continuous chain, said first sliding plate having a beveled end;

a second sliding plate slidably mounted on said base, collinear with said first sliding plate, located near the opposite end of the longitudinal dimension of said base, having a second idler sprocket mounted thereon for engaging said second continuous chain, said second sliding plate having a beveled end;

a link bar rigidly connecting said first and second sliding plates;

guide means mounted on said base engaging said sliding plates for movement of said plates along the longitudinal axis of said base;

gear means on said base rotatably connected to said first and second pairs of drive sprockets for rotation of said first and second continuous chains in opposite directions and adapted to reverse the direction of rotation of said continuous chains, said gear means being adapted to move the inside of said continuous chain loops relative to the longitudinal axis of said base at a speed slower than the outside loop sectors;

motor means on said base, connected to said gear means for turning said gear means in response to electrical signals from said controller;

whereby, when said motor means is energized, said first and second continuous chains are caused to pull said first and and second sliding plates, and link bar in one direction to engage said elongated sprocket on said pallet and to draw or expel said pallet for storage or retrieval.

3. A storage system as described in claim 1 wherein said pallet further comprises:

a base, substantially rectangular, having a top, bottom, and front, back, left, and right sides;

a first detenting groove in said base near the left side, extending along the longitudinal axis, adapted to receive and retain the left wheels of an automotive vehicle, when it is parked on said base;

a second detenting groove perpendicular to said first detenting groove, near the front of said base, adapted to receive and retain the front wheels of an automotive vehicle;

an elongated sprocket mounted on the bottom of said base in parallel relationship thereto, and spaced apart from said base; and locking means for locking said pallet in place in said stall, mounted on said elongated sprocket, and adapted to engage a lug in said stall and on said elevator.

4. A storage system as defined in claim 3 wherein said locking means comprises:

a first and second locking lug of substantially square cross section rigidly mounted to the storage structure near the ends of said stall, and extending into the proximity of said elongated sprocket when said elongated sprocket and pallet to which it is mounted, are installed in one of said stalls;

a first and second cam, substantially elliptical, pivotally mounted on said elongated sprocket, perpendicular thereto, and having a transverse groove near the end opposite the pivotal end, adapted to receive said locking lug, and a cam surface adjacent the groove adapted to follow said beveled end of said transfer means sliding plate, to lift said cam free from said locking lug for unlocking and removal of said pallet from said stall and for locking said pallet in said stall for storage.

5. A storage system as described in claim 1 wherein the sequencing means is a controller which comprises:

logic circuits connected electrically to switches for controlling the state thereof for application of power to said transfer means and to said two motor means in programmed sequence;

an interactive terminal having a keyboard for instruction entry and a data display for displaying said sensing means signals and for programming said first and second motor means and said transfer means;

a memory for logging the time of storage of each of said pallets int each of said stalls;

means for calculating the time of storage of said pallet in said stall logged in said memory, until time of removal of said pallet from said stall, multiplied by a charge-per-hour factor; and printout means for printing the total from said means for calculating.

* * * * *